United States Patent [19]

Kajiyama

[11] 4,354,576

[45] Oct. 19, 1982

[54] COMMAND SPEED GENERATOR SYSTEM FOR ELEVATOR CAR

[75] Inventor: Ryuichi Kajiyama, Inazawa, Japan

[73] Assignee: Mitsubishi Denki Kabushiki Kaisha, Tokyo, Japan

[21] Appl. No.: 202,180

[22] Filed: Oct. 28, 1980

[30] Foreign Application Priority Data

Oct. 30, 1979 [JP] Japan ..... 54-140090

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,425,515 | 2/1969 | McDonald et al. | 187/29 |
| 3,590,355 | 6/1971 | Davis et al. | 187/29 X |
| 3,773,146 | 11/1973 | Dixon, Jr. et al. | 187/29 |
| 4,083,430 | 4/1978 | Gingrich | 187/29 |
| 4,108,282 | 8/1978 | Satoh et al. | 187/29 |

FOREIGN PATENT DOCUMENTS 54-15345 9/1979 Japan .

*Primary Examiner*—J. V. Truhe
*Assistant Examiner*—W. E. Duncanson, Jr.
*Attorney, Agent, or Firm*—Wenderoth, Lind & Ponack

[57] ABSTRACT

A command elevator speed generator for an elevator car which includes a counter for counting pulses corresponding to a distance of movement of an elevator car, a position sensor on the car for delivering a positional signal upon the car reaching a predetermined distance short of a calling or a called floor and a resetting circuit which is responsive to the positional signal for clearing the counter. An electronic computer then subtracts the succeeding count from a predetermined distance stored in it to calculate a residual distance to the floor for each of its calculating periods. A command deceleration signal is then read out from the computer to decelerate the car.

2 Claims, 5 Drawing Figures

COMMAND SPEED GENERATOR SYSTEM FOR ELEVATOR CAR

BACKGROUND OF THE INVENTION

This invention relates to improvements in a command speed generator system for an elevator car.

Speed feedback control systems for controlling the speed of the elevator car in accordance with a command deceleration signal are employed in order that the elevator car is decelerated with a comfortable ride maintained and lands accurately at that floor of a building an which the car is predetermined to be stopped due to a call resistered thereon or on the elevator car. It has been recently proposed to cause the elevator car to decelerate and land at such a floor by using an electronic computer.

To this end, it has been a common practice to count an output from a pulse generator connected to a hoist motor involved to determine the amount of movement of the elevator car. When a position sensor disposed in an associated hoistway senses that the elevator car has reached a predetermined distance short of that floor at which the elevator car is predetermined to land, the distance of movement of the car is entered into the electronic computer at the beginning of each of the calculating time periods. The electronic computer calculates a residual distance to the abovementioned floor by subtracting the distance of movement of the car from the predetermined distance. Following this, the computer reads out a command deceleration signal stored with respect to the calculated residual distance in a read only memory device involved therefrom. Then, the speed of the elevator car is controlled in accordance with the command deceleration signal thus read out.

The electronic computer is normally arranged such that the calculating or an interrupting time period is not normally synchronized with the time of operation of the position sensor. Therefore, when the elevator car reached the position sensor, the calculation of the residual distance is not always immediately initiated. A time point at which the position sensor is operated occurs, in many cases, between the adjacent calculating time periods of the electronic computer with the result that the elevator car may travel a distance L in the worst case where L is equal to the product of a car speed v and the calculating time period $\Delta t$. However, the electronic computer has therein the predetermined distance (which is designated by the reference character A) stored at the beginning of the calculating time period, resulting in the setting of a magnitude of distance which is greater by the distance L than the actual distance. In other words, while the command deceleration signal to be delivered must properly have a magnitude $V_1$ bearing a relationship to the residual distance of (A–L), a command deceleration signal is actually delivered having a magnitude $V_2$ bearing a relationship to the residual distance A and is therefore greater than the magnitude $V_1$. That is, there has been delivered a command deceleration signal having an error with respect to the landing of the elevator car. The magnitude $V_2$ is greater than that of the proper command deceleration signal resulting in a deterioration of the landing accuracy.

Accordingly, it is an object of the present invention to eliminate the objection to the prior art practice as described above by the provision of a new and improved command speed generator system for an elevator car for generating a command deceleration signal free from distance error, regardless of the time point where an output from a position sensor involved is entered into an associated electronic computer.

SUMMARY OF THE INVENTION

The present invention provides a command speed generator system for: a car comprising an elevator counter means for counting pulses corresponding to a distance of movement of the elevator car; an electronic computer means into which a count on the counter means is entered upon the elevator car reaching a predetermined distance short of a floor on which the elevator car is predetermined to stop and for each of predetermined calculating time periods thereof, the electronic computer subtracting the entered count from the predetermined distance so as to calculate a residual distance between the actual position of the elevator car and the floor; a signal generator means connected to the electronic computer to deliver a command deceleration signal bearing a relationship to the residual distance, and a resetting circuit means connected to the counter means to generate a pulse for resetting the counter means in response to the elevator car reaching the predetermined distance.

Preferably the resetting circuit means may include a pair of AND gates, one of which has a first input supplied with an up signal for indicating the ascent of the elevator car, a second input supplied with a range sensing signal for indicating that the elevator car is entering a predetermined range below the floor during the ascent of the elevator car, a third input supplied with a positional signal for indicating that the elevator car is reaching the predetermined distance during the ascent of the elevator car, and a fourth input supplied with the positional signal through a NOT gate and an attenuation network to produce the pulse for resetting the counter to zero; and the other of the AND gates has a first input supplied with a down signal for indicating the descent of the elevator car, a second input supplied with a range sensing signal for indicating that the elevator car is entering the predetermined range above the floor during the descent of the elevator car, a third input supplied with a positional signal for indicating that the elevator car is reaching the predetermined distance during the descent thereof, and a fourth input supplied with the positional signal through a NOT gate and an attenuation circuit to form a pulse for resetting the counter to zero.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
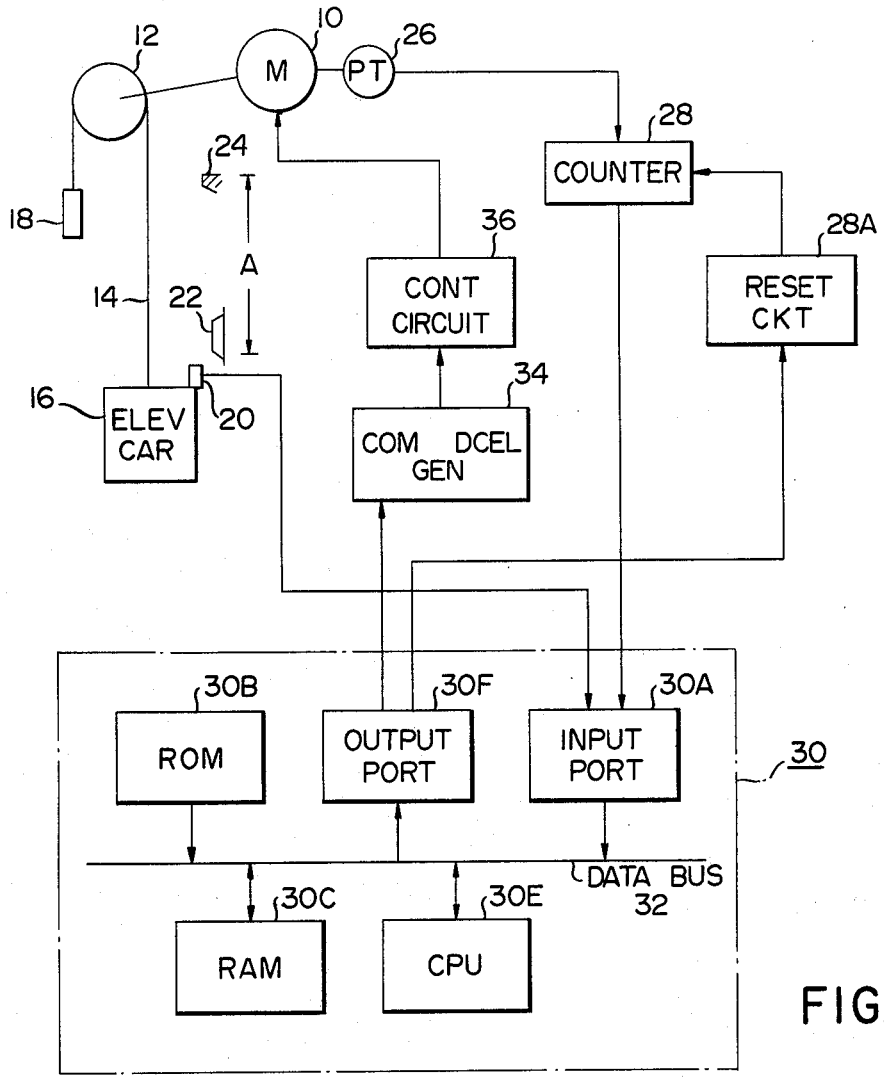
FIG. 1 is a block diagram of one embodiment according to the command speed generator system of the present invention and a schematic view of an elevator system with which the present invention is operatively associated.

Referring now to FIG. 1 of the drawings, there is illustrated one embodiment according to the command speed generator system of the present invention and an elevator system with which the present invention is operatively associated. The arrangement illustrated comprises an electric hoist motor 10, a hoist wheel 12 driven by the hoist motor 10, and a traction rope 14 trained over the hoist wheel 12 and connected at its ends to an elevator car 16 and a counterweight 18. The elevator car 16 is provided on the outer surface of the ceiling thereof at one edge with a switch forming an up position sensor 20. The up position sensor 20 is arranged to engage a cam 22 disposed at a predetermined distance A below a floor 24 as viewed in FIG. 1 served by the elevator car 16 and in a hoistway (not shown). That is, the cam 22 is operated when the elevator car 16 ascends and located at the predetermined distance A short of a floor 24.

It will readily be understood that a cam such as shown by the reference numeral 22 is located at the predetermined distance short of each floor.

The hoist motor 10 is connected to a pulse generator 26 for generating pulses whose number is proportional to the number of rotations of the hoist motor 10. Then pulse generator 26 is connected to a counter 28 for counting the pulses from the pulse generator 26. The counter 28 is reset to zero by a resetting circuit 28A and is also connected to an electronic computer, in the example illustrated, a microprocessor, generally designated by the reference numeral 30, and commercially available as TYPE 8085 from the Intel Corporation, for example. However, it is to be understood that the electronic computer may comprise any suitable marketed micro-processor.

The micro-processor 30 includes an input port 30A connected to the switch 20 and also to a data bus 32, and a read only memory device (which is abbreviated hereinafter to "ROM") 30B, a random access memory device (which is abbreviated hereinafter to "RAM") 30C, a central processor 30E and an output port 30F connected to the data bus 32. The input port 30A and the ROM 30B are arranged to supply data to the data bus 32 while the output port 30F is arranged to receive data from the data bus 32. The RAM 30C and central processor 30E are arranged to supply and receive data to and from the data bus 32.

In the example illustrated, the input port 30A, the ROM 30B, the RAM 30C, the central processor 30E and the output port 30F are the TYPES 8212, 2716, 2114A, 8085A and are 8212 commercially available from the Intel Corporation respectively.

The ROM 30B has stored therein a plurality of command deceleration magnitudes in the form of a plurality of data tables 30B1, 30B2, 30B3, . . . , 30Bn-1, and 30Bn (see FIG. 2) corresponding to the residual distances between the actual positions of the elevator car and an associated floor such as the floor 24 and including the predetermined distance A for each pair of adjacent floors. The RAM 30 has data stored at its addresses therein and data can be written into and read out from the RAM 30C at its addresses.

The input port 30A is connected to both the resetting circuit 28A and a command deceleration generator 34 which is subsequently connected to the hoist motor 10 through a control circuit 36.

Figure 3:
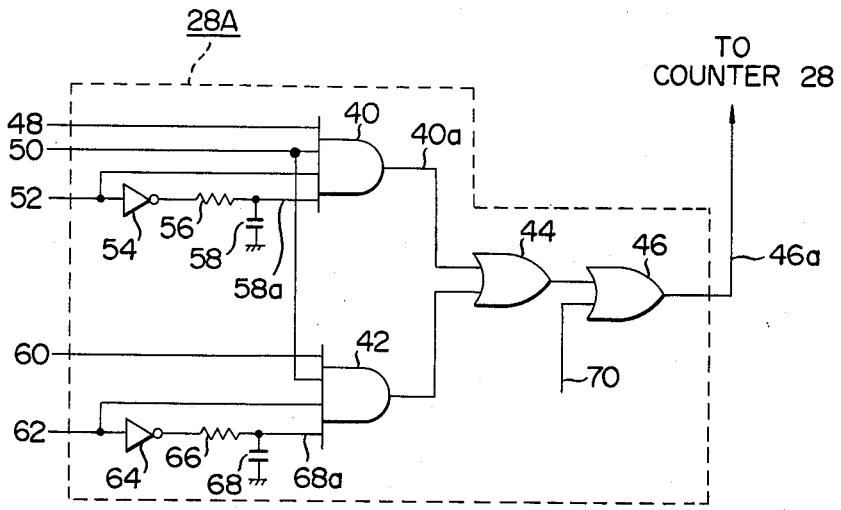
FIG. 3 is a circuit diagram of the details of the resetting circuit shown in FIG. 1.

The resetting circuit 28A is preferably of a circuit configuration as shown in FIG. 3. The arrangement illustrated comprises a pair of AND gates 40 and 42, an OR gate 44 having a pair of inputs connected to the outputs of the AND gates 40 and 42 respectively, and another OR gate 46 having one input connected to the output of the OR gate 44 and an output connected to the counter 28.

The AND gate 40 has a first input supplied with an up signal 48, a second input supplied with a range sensing signal 50, a third input supplied with a positional signal 52 for an up direction and a fourth input connected to an output of a NOT gate (i.e. - inverter) 54 through a resistor 56 with the junction of the resistor 56 and the fourth input connected to ground through a capacitor 58. The positional signal 52 is also applied to the input to the NOT gate 54.

The up signal 48 is put in its high level H during the ascent of the elevator car 16 and the range sensing signal 50 is put in its high level H when the elevator car 16 is entered into a predetermined constant range below or above that floor to which the traveling car 16 is nearest in a direction of travel thereof, in the example illustrated, the floor 24. The positional signal 52 is put in its high level H upon the position sensor 20 engaging the cam 22.

Similarly, the AND gate 42 has a first input supplied with a down signal 60, a second input connected to the second input to the AND gate 40, a third input supplied with a positional signal 62 for a down direction and a fourth input connected to an output of a NOT gate 64 through a resistor 66 with the junction of the resistor 66 and the fourth input connected to ground through the capacitor 68. The positional signal 62 is also supplied to the input to the NOT gate 64.

The down signal 60 is put in its high level H during the descent of the elevator car 16 and the positional signal 62 is put in its high level H upon a position sensor (not shown) for the down direction engaging a cam (not shown) also disposed at the predetermined distance A above each floor in the direction of descent of the elevator car.

The OR gate 46 has its other input supplied with clock pulses with a predetermined pulse repetition period delivered from the central processor 30E.

Figure 2:
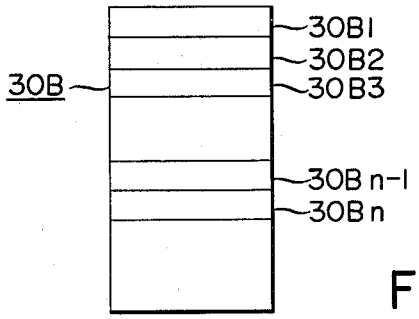
FIG. 2 is a schematic diagram illustrating the status of data stored in the read only memory device shown in FIG. 1.

The operation of the arrangement shown in FIG. 1 will now be described in conjunction with both FIG. 2 wherein there is a status in which data are stored in the ROM 30B, and FIG. 4 wherein there are illustrated waveforms developed at various points in the arrangement shown in FIG. 3.

When the elevator car 16 is travels upwardly, an up travel relay (not shown) is energized and picked up to generate an up signal 48 in its high level H and the pulse generator 26 generates pulses which are, in turn, counted by the counter 28. When the elevator car 16 reaches the predetermined distance A short of that floor on which the car is predetermined to be stopped due to the presence of a call registered thereon or on the car, in the example illustrated, the floor 24, the position sensor 20 engages the up cam 22 resulting in the generation of the up positional signal 52 in its high level H from the up positional sensor 22 (see waveform labelled 48, FIG. 4). When the central processor 30E senses that positional signal 52 through the input port 30A, it reads out the predetermined distance A stored in the ROM 30B therefrom and writes it into the RAM 30C at an address destined therefor. Then, the count on the counter 28 is supplied to the central processor 30E through the input port 30A for each of the calculating time periods while the central processor 30E subtracts the applied output from the predetermined distance A read out from the RAM 30C to calculate a residual distance R between the actual position of the elevator car 16 and the floor 24.

Meanwhile, command deceleration magnitudes are successively picked up from the data table 30B1, 30B2, . . . , 30Bn stored in the ROM 30B, one for each calculating time period, and are successively supplied to the command deceleration generator 34 through the output port 30F. In the generator 34, the command deceleration magnitudes are successively converted to corresponding analog magnitudes respectively which, in turn, control the hoist motor 10 through the control circuit 36. This results in the elevator car 16 decelerating smoothly until it lands accurately at the floor 24.

During the ascent thereof, the elevator car 16 enters a predetermined constant range below the floor 24 to cause range sensing signal 50 to be put in its high level H as shown at waveform labelled 50 in FIG. 4. Under these circumstances, the engagement of the position sensor 20 with the cam 22 causes the positional signal 52 to be put in its high level H as shown at waveform labelled 52 in FIG. 4.

The up signal 48, the range sensing signal 50 and the positional signal 52 as described above are applied to the first, second and third inputs to the AND gate 40 while the positional signal 52 is also applied to the fourth input to the AND gate 40 through the NOT gate 54 and the resistor 56 interconnected serially. The NOT gate 54 provides an output in its low level L but an output **58*a* from the resistor 56 is gradually decreased to its low level L with a time constant as determined by the resistor 56 and the capacitor 58 forming an attenuation network as shown at waveform labelled 58*a* in FIG. 4**.

Figure 4:
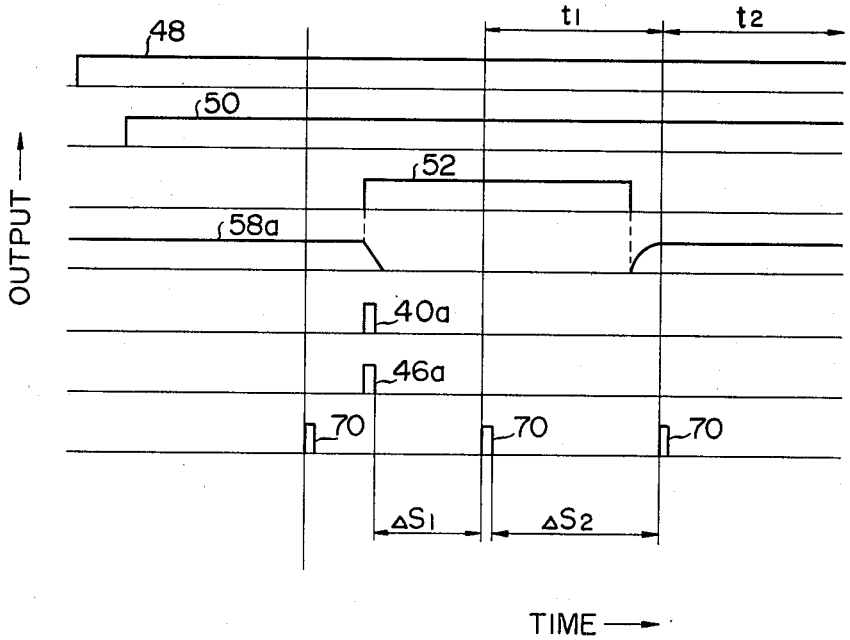
FIG. 4 is a graph illustrating waveforms developed at various points in the arrangement shown in FIG. 3.

Accordingly, the AND gate 40 produces a pulse **40*a* having a constant pulse width as shown at waveform labelled 40*a* in FIG. 4. That pulse 40*a* is supplied to the OR gate 46 through the OR gate 44. As a result, the OR gate 46 supplies a pulse 46*a* identical to the pulse 40*a* (see waveform labelled 46*a*, FIG. 4) to the counter 28 to reset it to zero. That is, the counter 28** is cleared.

When the central processor 30E delivers one clock pulse 70 at the beginning of the next succeeding calculating period $t_1$ as shown at waveform labelled 70 in FIG. 4, an initial magnitude $(A-\Delta S_1)$ of the residual distance is calculated and written into the RAM 30C in the calculating period $t_1$ where $\Delta S_1$ as shown in FIG. 4 designates a distance through which the elevator car 16 travels between a time point where the position sensor 22 is operated and a time point where the calculation of the residual distance is initiated. This is followed by a calculation of a residual distance $(A-\Delta S_1-S_2)$ in the next succeeding calculating period $t_2$ where $\Delta S_2$ as shown in FIG. 4 designates a distance through which the elevator car 16 travels for the calculating period $t_2$. Thereafter, the calculation as described above is repeated.

From the foregoing it is seen that the residual distance is correctly calculated in the next succeeding calculating period. Therefore, the landing accuracy is prevented from deteriorating due to a distance error.

While the present invention has been described in conjunction with the ascent of the elevator car it is to be understood that the process as described above is repeated with the descent of the elevator car except for the following respects: The down signal 60 in its high level H is applied to the AND gate with the range sensing signal 50 put in its high level H when the elevator car enters a predetermined constant range above that floor having a call registered thereon or on the car in the direction of descent of the car as calculated by the central processor 30E. The positional signal 62 for the downward direction is similar to the positional signal 48 and similarly attenuated by an attenuation network formed of the resistor 66 and the capacitor 68.

Figure 5:
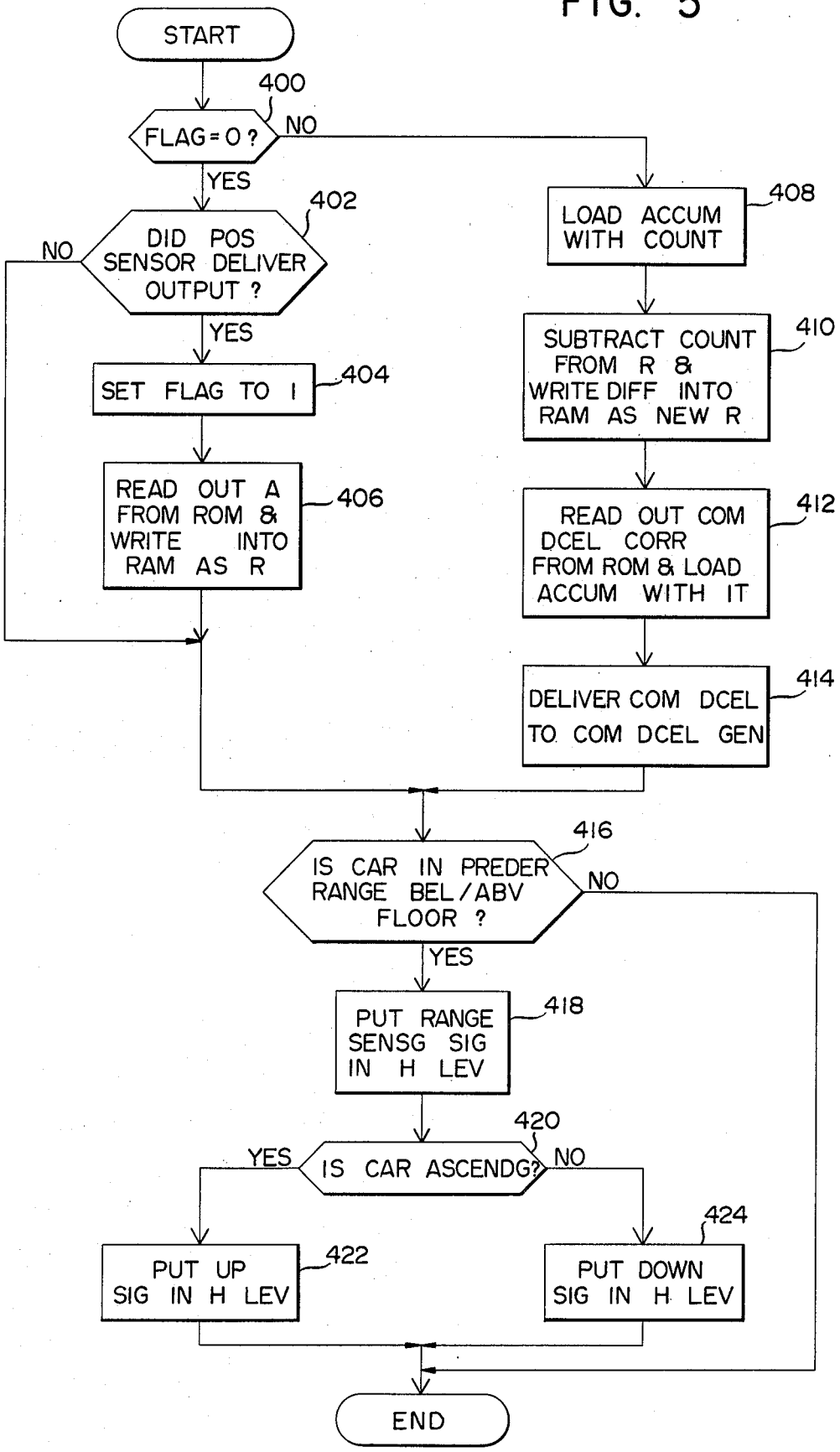
FIG. 5 is a flow chart illustrating a program for the operation of the arrangement shown in FIG. 1.

The operation of the arrangement shown in FIG. 1 will now be described in more detail with reference to FIG. 5 wherein there is illustrated a flow chart describing a program for the operation thereof.

That program is stored in the ROM 30B and started to be interruptively executed for each of predetermined constant time periods or the calculating time periods as described above in conjunction with FIG. 4 under the control of a timer (not shown). Also, a separate program is executed to cause the central processor 30E to perform the initializing process required for the rise of an associated elevator control system.

The program put in the step START goes to the step 400 where it is determined if a calculation route control flag is of a binary ZERO. The flag is reset to the binary ZERO by both an initializing program (not shown) and a program (not shown) executed during the stoppage of the elevator car 16. When the step 400 determines that the flag is of the binary ZERO, the step 402 is reached where the signal from the position sensor 22 is applied to the central processor 30E through the input port 30A and it is determined whether or not the signal 52 (see FIG. 3) is delivered by the position sensor 20. When the position sensor 20 delivers the signal 52 as determined in the step 402, the program goes to the step 404 where the flag is set to a binary ONE. Then, in the step 406, the predetermined distance A stored in the ROM 30B is read out therefrom and written into the RAM 30C at an address destined therefor as a residual distance R.

Thereafter, the steps 402, 404 and 406 are prevented from being executed until the elevator 16 is stopped on the floor 24.

On the other hand, when the step 402 determines that the position sensor 20 does not deliver the signal 52, the program is put in the state in which the process of the step 406 has been completed to be executed.

It is assumed that the step 400 has determined that the flag is not equal to the binary ZERO. In the assumed conditions, a residual distance R and a corresponding command deceleration magnitude are calculated in the steps 408 through 414 after the elevator car 16 has approached the floor 24 and traveled past the cam 22. More specifically, the program goes to the step 408 where the count on the counter 28 loads an accumulator (which is disposed within the central processor 30E and not shown) through the input port 30A.

Then, the step 410 is reached where the central processor 30E is operated to read out the residual distance R stored in the RAM 30C at an address destined therefor from the latter, to subtract the entered count from the read residual distance R to calculate a new residual distance R and write it into the RAM 30C.

Following this, a command deceleration magnitude is picked up from the data tables 30B1, 30B2, . . . , 30Bn-1, and 30Bn stored in the ROM 30B and then loads the accumulator in the step 412. That magnitude loaded in the accumular is supplied via the output port 30F to the command deceleration generator device 34 in the step 414.

After the step 402 has determined that the position sensor 20 does not deliver the signal 62 or after either one of the steps 406 and 414 has been completed, the step 416 determines if the elevator car 16 is in the predetermined range above or below the floor 24. If so, the range sensing signal 50 (see FIG. 4) is put in its high level H in the step 418.

Then, the step 420 determines if the elevator car 16 is ascending. If so, the up signal 48 (see FIG. 4) is put in its high level H in the step 422. The up signal 48 in its high level is applied to the reset circuit 28A through the output port 30A. At that time the program execution is completed. Therefore, the step END is reached.

On the other hand, when the step 420 determines that the elevator car 16 is not ascending and instead descending, the down signal 60 (see FIG. 4) is put in its high level H. Then the down signal 60 is similarly supplied to the resetting circuit 28A through the output port 30A. Accordingly, the execution of the program has been completed.

From the foregoing it is seen that, according to the present invention, a counter counts pulses corresponding to a distance of movement of an elevator car, and the resulting count is cleared upon the elevator car reaching a predetermined distance short of that floor on which the car is predetermined to be stopped. Thereafter, the succeeding count is entered into an associated central processor for each of predetermined calculating time periods and subtracted from the predetermined distance to calculate a residual distance to the floor by the central processor. Accordingly, the present invention is advantageous in that a correct residual distance can be calculated without any distance error dependent upon a time point where data are entered into the micro-processor or an electronic computer.

While the present invention has been illustrated and described in conjunction with a single preferred embodiment thereof, it is to be understood that numerous changes and modifications may be resorted to without departing from the spirit and scope of the present invention.

What is claimed is:

1. A command speed generator system for an elevator car comprising: a counter means for counting pulses corresponding to a distance of movement of said elevator car; an electronic computer means which is independent of said counter means and contains a central processing unit, wherein a count from said counter means is entered into said computer means upon said elevator car reaching a predetermined distance short of a floor on which said elevator car is predetermined to stop and for each of predetermined calculating time periods thereof, and wherein said electronic computer subtracts said entered count from said predetermined distance so as to calculate a residual distance corresponding to the distance between the actual position of said elevator car and said predetermined floor; a signal generator means connected to said electronic computer for delivering a command deceleration signal representative of said residual distance; and a resetting circuit means connected to said counter means and independent of said central processing unit for generating a pulse for resetting said counter means to zero in response to said elevator car reaching said predetermined distance.

2. A command speed generator system for an elevator car as claimed in claim 1, wherein said resetting circuit means includes a pair of AND gates, one of which has a first input supplied with an up signal for indicating the ascent of said elevator car, a second input supplied with a range sensing signal for indicating that said elevator car is entering a predetermined range below said predetermined floor during the ascent of said elevator car, a third input supplied with a positional signal for indicating that said elevator car is reaching said predetermined distance during the ascent of said elevator car, and a fourth input supplied with said positional signal through a NOT gate and an attenuation network, so as to produce said pulse for resetting said counter means to zero; and the other of said pair of AND gates including a first input supplied with a down signal for indicating the descent of said elevator car, a second input supplied with a range sensing signal for indicating that said elevator car is entering said predetermined range above said predetermined floor during the descent of said elevator car, a third input supplied with a positional signal for indicating that said elevator car is reaching said predetermined distance during the descent thereof, and a fourth input supplied with said positional signal through a NOT gate and an attenuation circuit so as to produce said pulse for resetting said counter means to zero.

* * * * *